US007536836B2

(12) United States Patent
Moser Rossel

(10) Patent No.: US 7,536,836 B2
(45) Date of Patent: May 26, 2009

(54) REMOVABLE CEILING PANEL

(76) Inventor: Roberto Felipe Moser Rossel, N° 1129 Depto 52, Las Condes, Santiago (CL)

( * ) Notice: Subject to any disclaimer, the term of this patent is extended or adjusted under 35 U.S.C. 154(b) by 337 days.

(21) Appl. No.: 11/186,520

(22) Filed: Jul. 21, 2005

(65) Prior Publication Data

US 2006/0162283 A1 Jul. 27, 2006

(30) Foreign Application Priority Data

Jan. 13, 2005 (CL) ..... 0058-2005

(51) Int. Cl.
*E04B 2/00* (2006.01)
*E04B 5/00* (2006.01)
*E04B 9/00* (2006.01)

(52) U.S. Cl. ..... 52/506.08; 52/506.01; 52/506.09

(58) Field of Classification Search ..... 52/506.08, 52/506.09, 506.1, 506.07, 798.1, 384, 506.01, 52/506.06; 428/192
See application file for complete search history.

(56) References Cited

U.S. PATENT DOCUMENTS 2,890,583 A * 6/1959 Grosskortenhaus ..... 52/506.09
2,895,180 A * 7/1959 Byssing ..... 52/779
3,001,616 A * 9/1961 Griffin ..... 52/690
3,153,304 A * 10/1964 Evangelista ..... 52/144
3,228,163 A * 1/1966 Lindstrom ..... 52/506.09
3,276,179 A * 10/1966 Rallis ..... 52/506.09
3,332,194 A * 7/1967 Jack ..... 52/591.1
3,381,437 A * 5/1968 Kidney ..... 52/779
3,492,935 A * 2/1970 Thomas ..... 454/292
3,841,048 A * 10/1974 Jahn ..... 52/731.7
3,913,292 A * 10/1975 Braekkan ..... 52/406.1
4,969,304 A * 11/1990 Helderman ..... 52/780
5,228,254 A * 7/1993 Honeycutt, Jr. ..... 52/241
5,355,648 A * 10/1994 Graver et al. ..... 52/506.08
5,428,930 A * 7/1995 Bagley et al. ..... 52/506.07
5,623,800 A * 4/1997 Shinkosky ..... 52/468
5,876,810 A * 3/1999 Bodine et al. ..... 428/33
6,101,777 A * 8/2000 Bodine et al. ..... 52/506.06
6,108,994 A * 8/2000 Bodine ..... 52/506.07
6,230,463 B1 * 5/2001 Bodine ..... 52/506.07
6,260,325 B1 * 7/2001 Wendt et al. ..... 52/506.07
6,389,771 B1 * 5/2002 Moller ..... 52/506.06
7,211,310 B2 * 5/2007 Chen et al. ..... 428/54
2003/0097808 A1 * 5/2003 Sabatini ..... 52/384

(Continued)

FOREIGN PATENT DOCUMENTS

GB 2116601 A * 9/1983

*Primary Examiner*—Richard E Chilcot, Jr.
*Assistant Examiner*—Andrew J Triggs
(74) *Attorney, Agent, or Firm*—Thomas R. FitzGerald, Esq.; Hiscock & Barclay, LLP

(57) ABSTRACT

The invention relates to a removable ceiling panel, a rectangular material with a face, a back and four sides with edges, installed from beneath and retained horizontally by its four sides, concealing the profiled suspension grid. The panel is supported at the four sides and it is retained by gravity in the vertical direction. The profiled suspension grid is of the standard type known in the market. The design of the sides of the panel permits carrying out its installation on the basis of simple precise movements, which procedure for installation also forms part of the patent applied for. Said installation movements are not natural and, consequently, render the panels aseismic.

12 Claims, 15 Drawing Sheets

U.S. PATENT DOCUMENTS

2003/0182894 A1* 10/2003 Galsgaard et al. ..... 52/747.1
2003/0213200 A1* 11/2003 Hornidge ..... 52/506.06
2006/0162283 A1* 7/2006 Moser Rossel ..... 52/798.1
2008/0066394 A1* 3/2008 Nielsen ..... 52/83

* cited by examiner

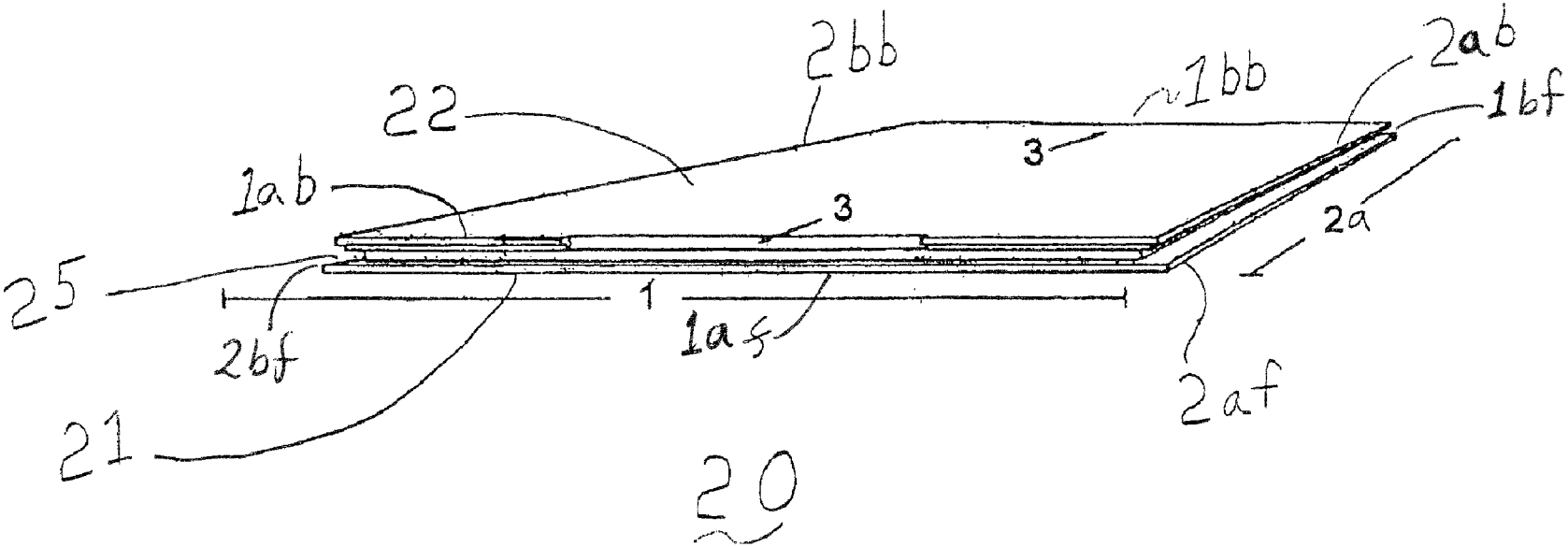
Figure No. 1

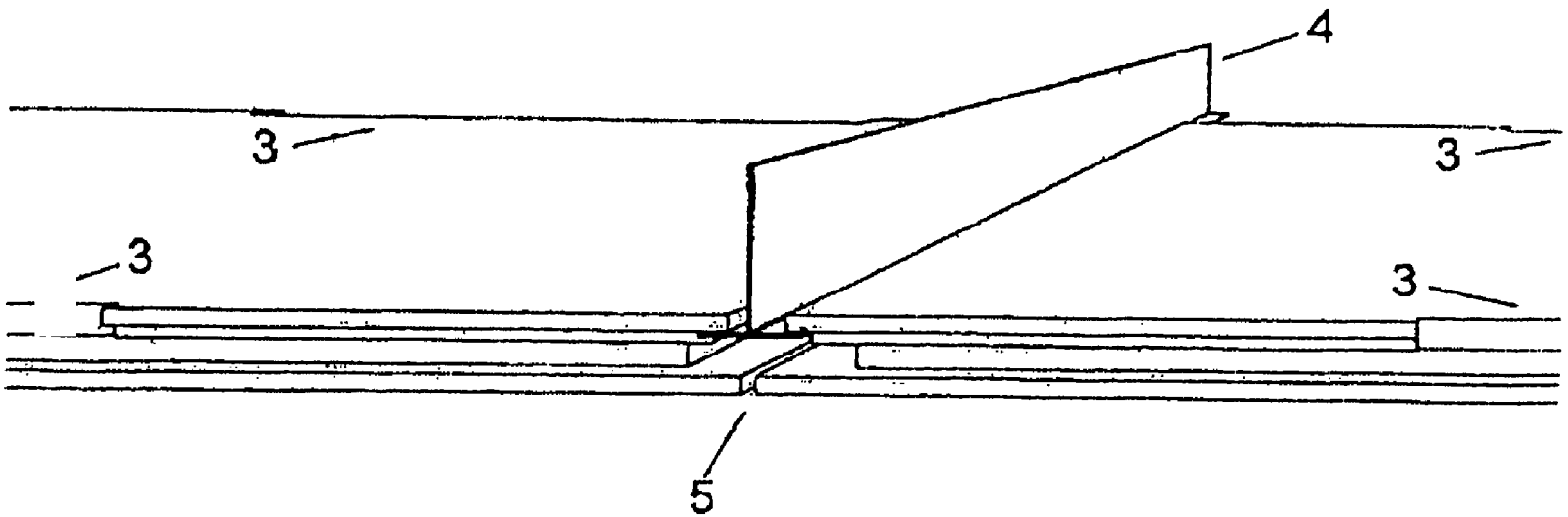
Figure No. 2

Figure No. 3
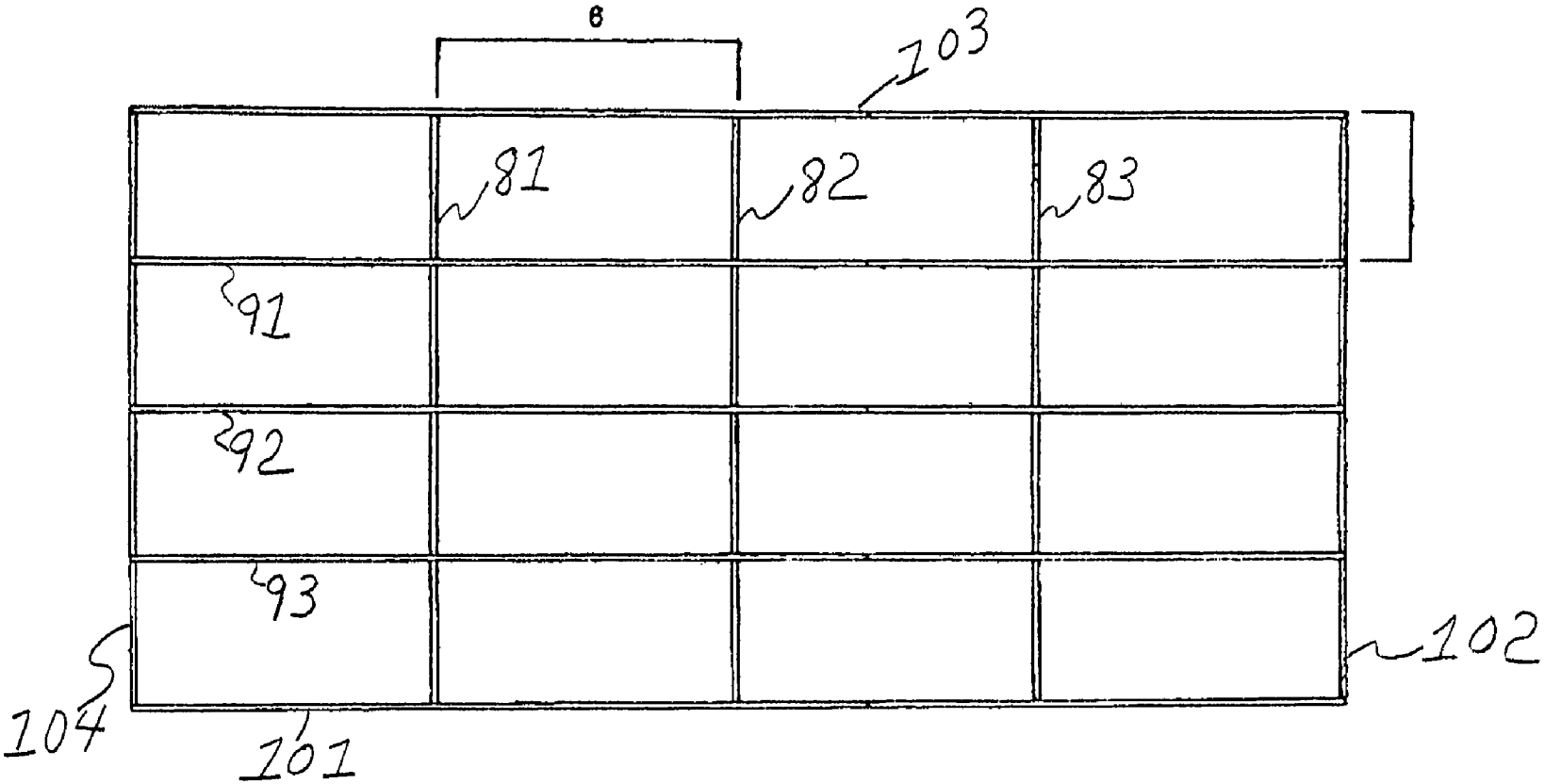

Figure No. 4
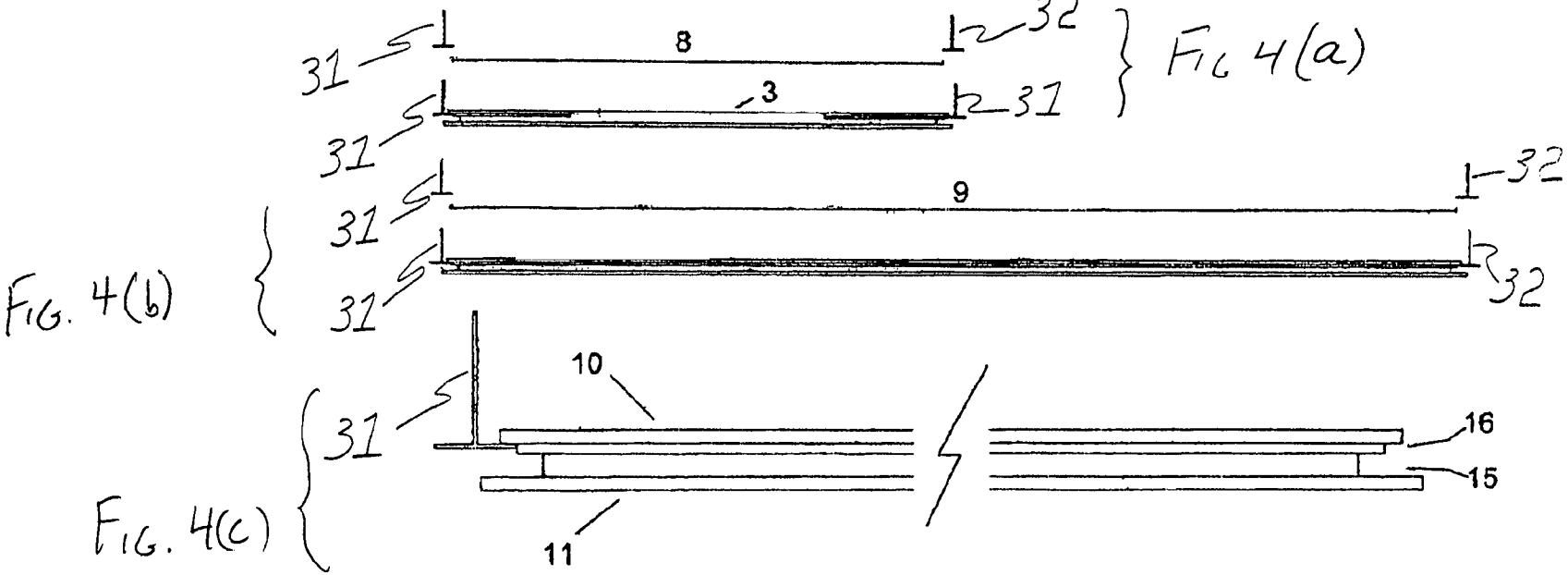

Figure No. 5
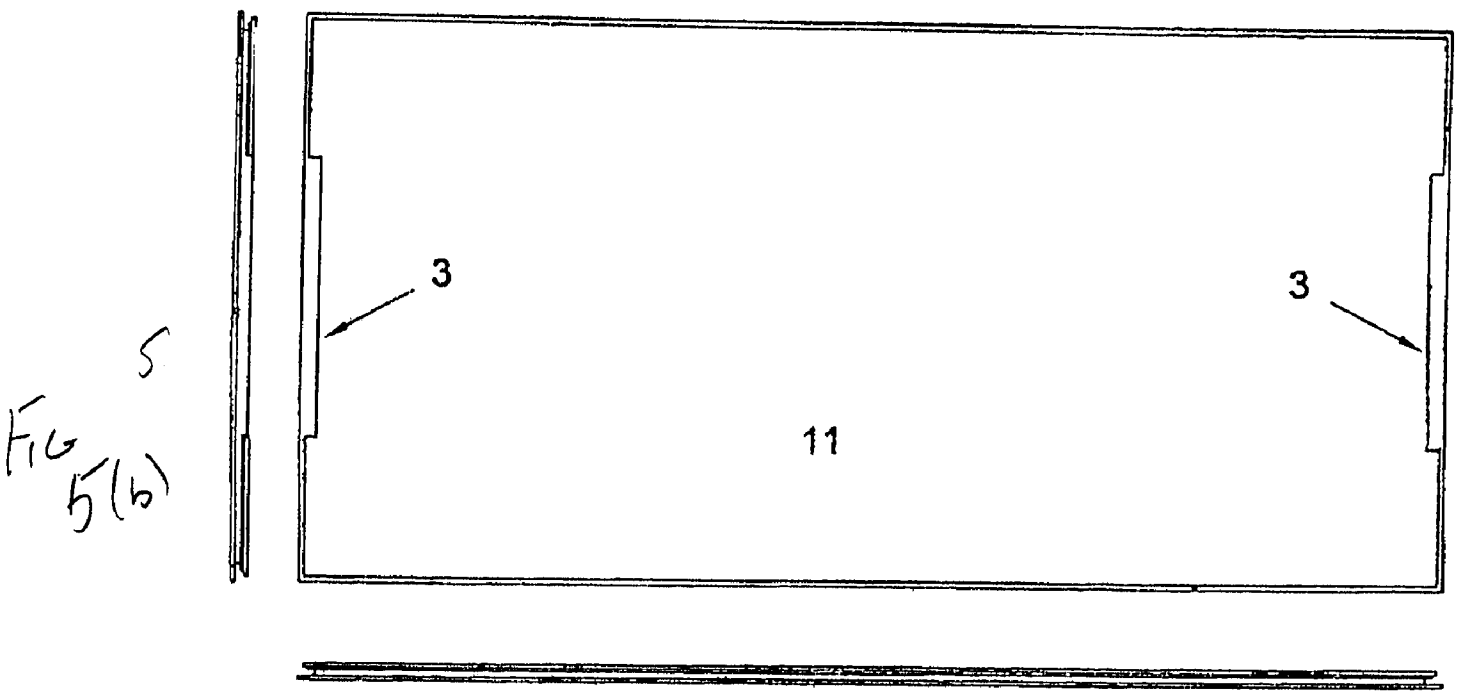

Figure No. 6
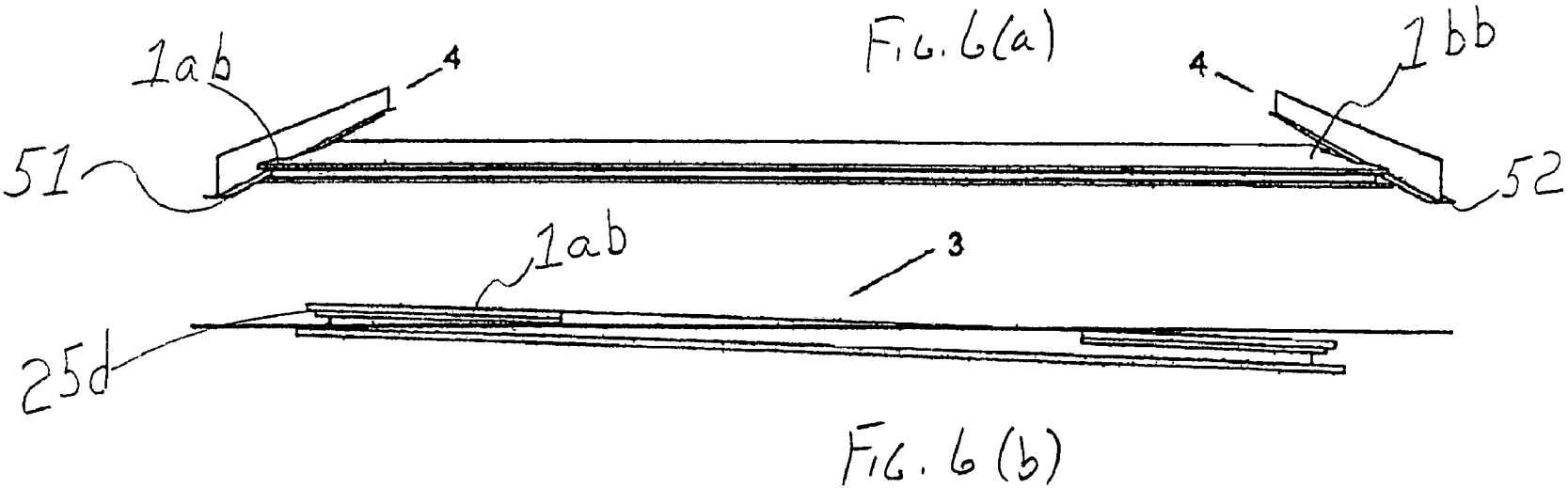

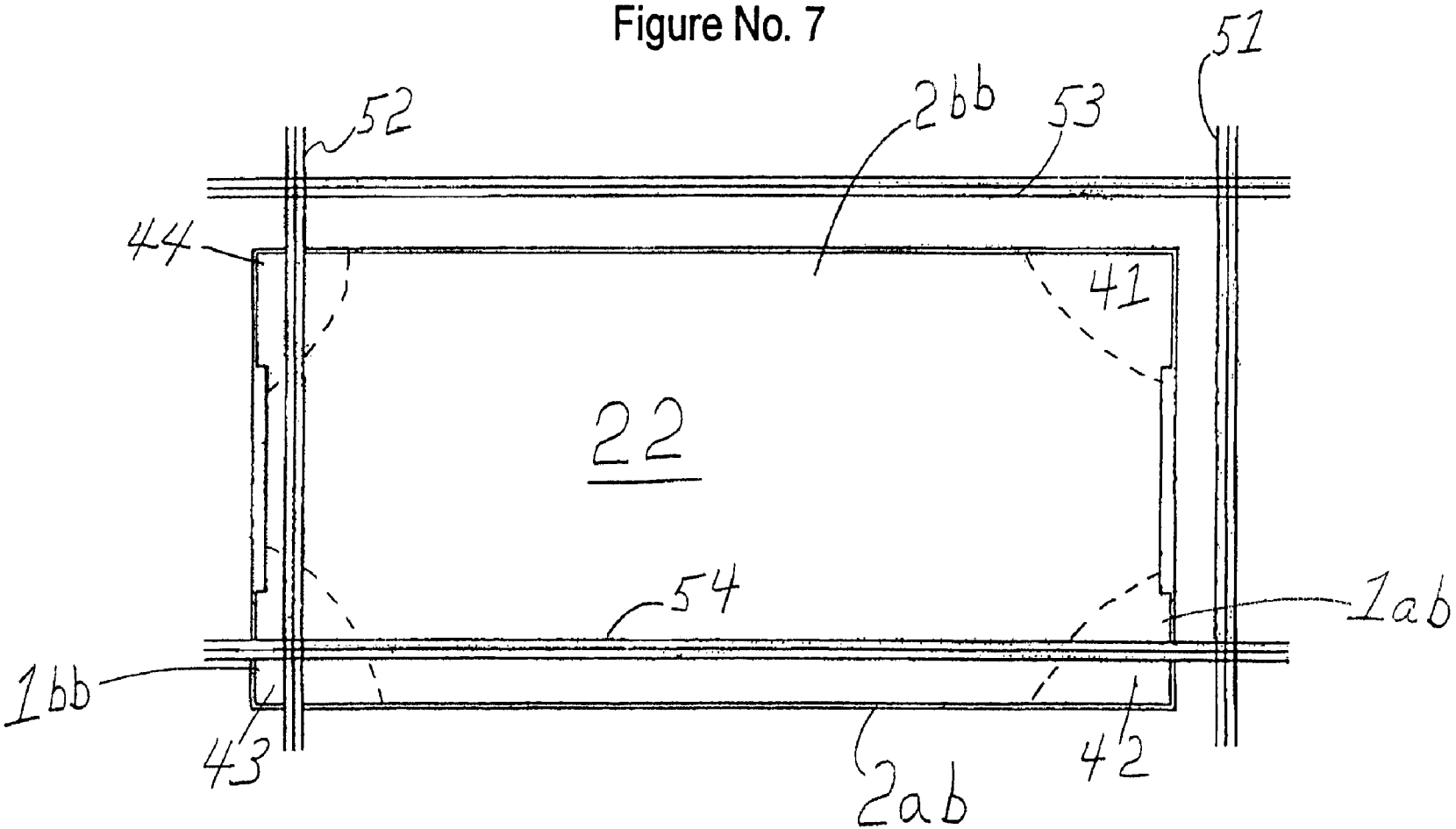
Figure No. 7

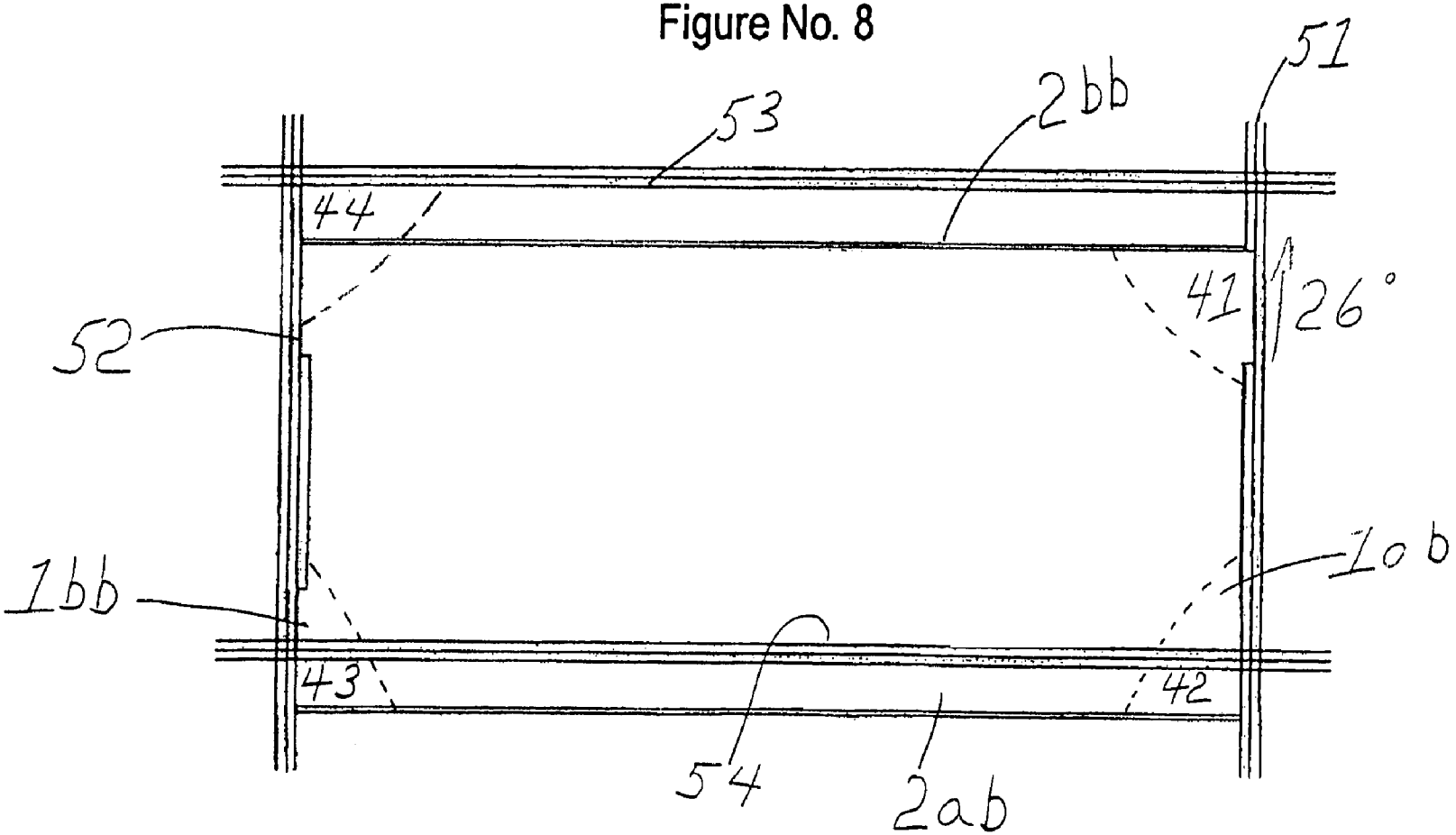
Figure No. 8

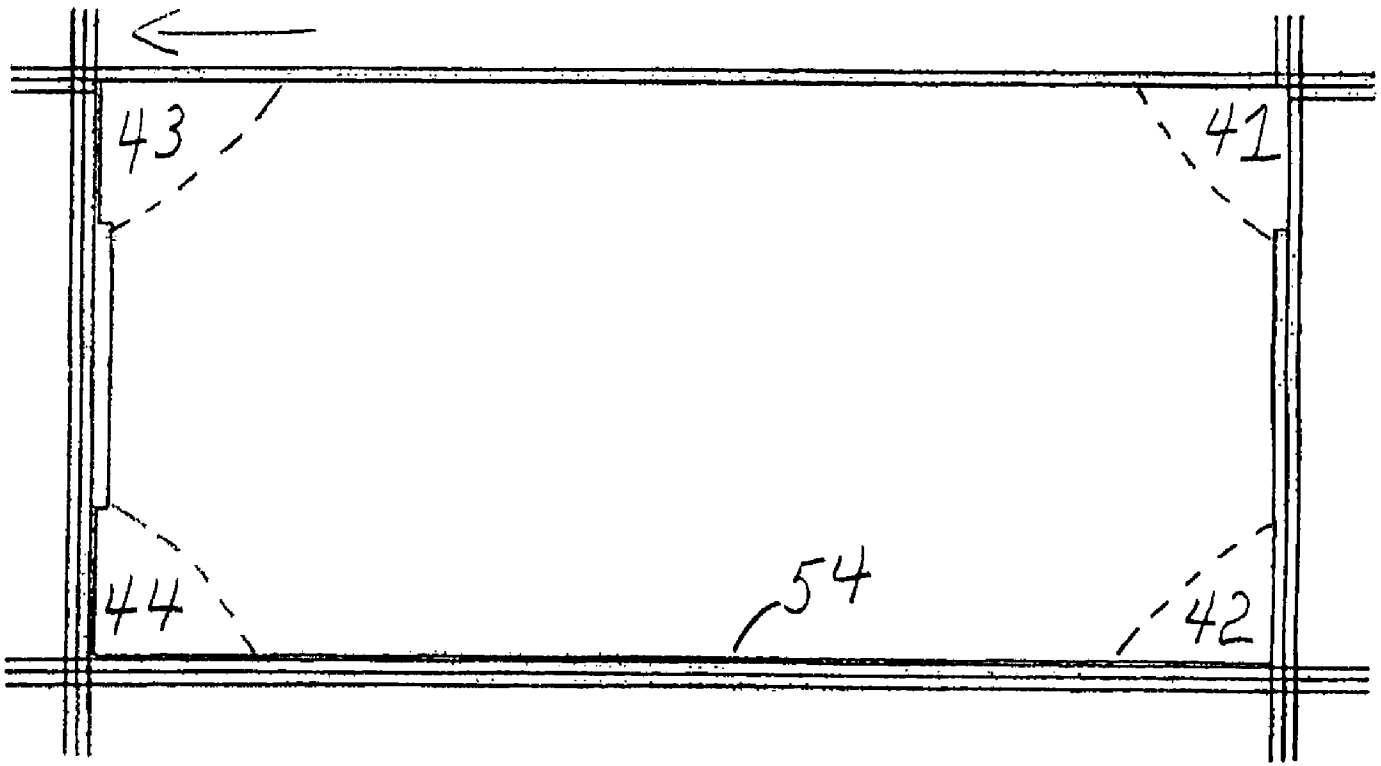
Figure No. 9

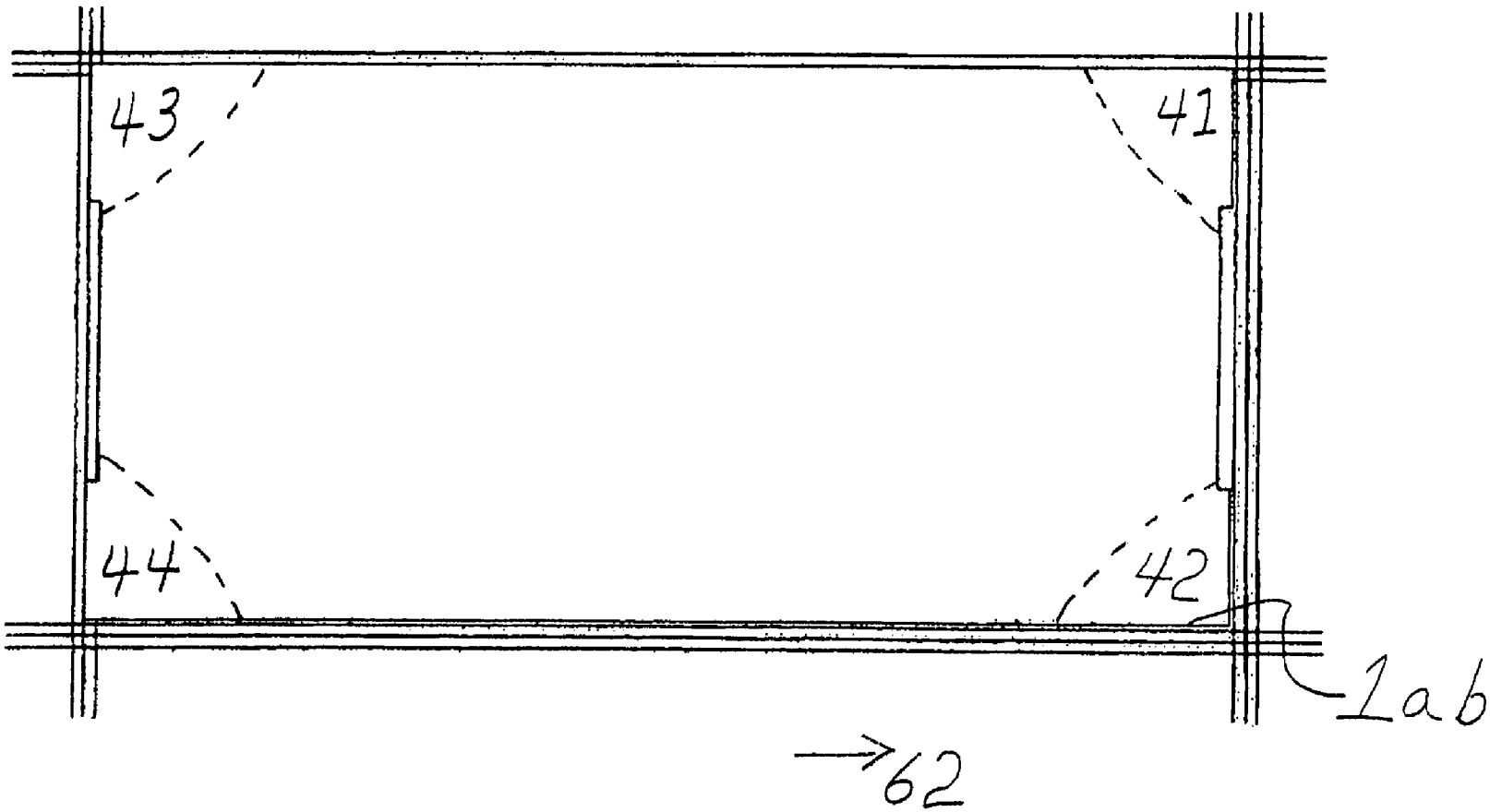
Figure No. 10

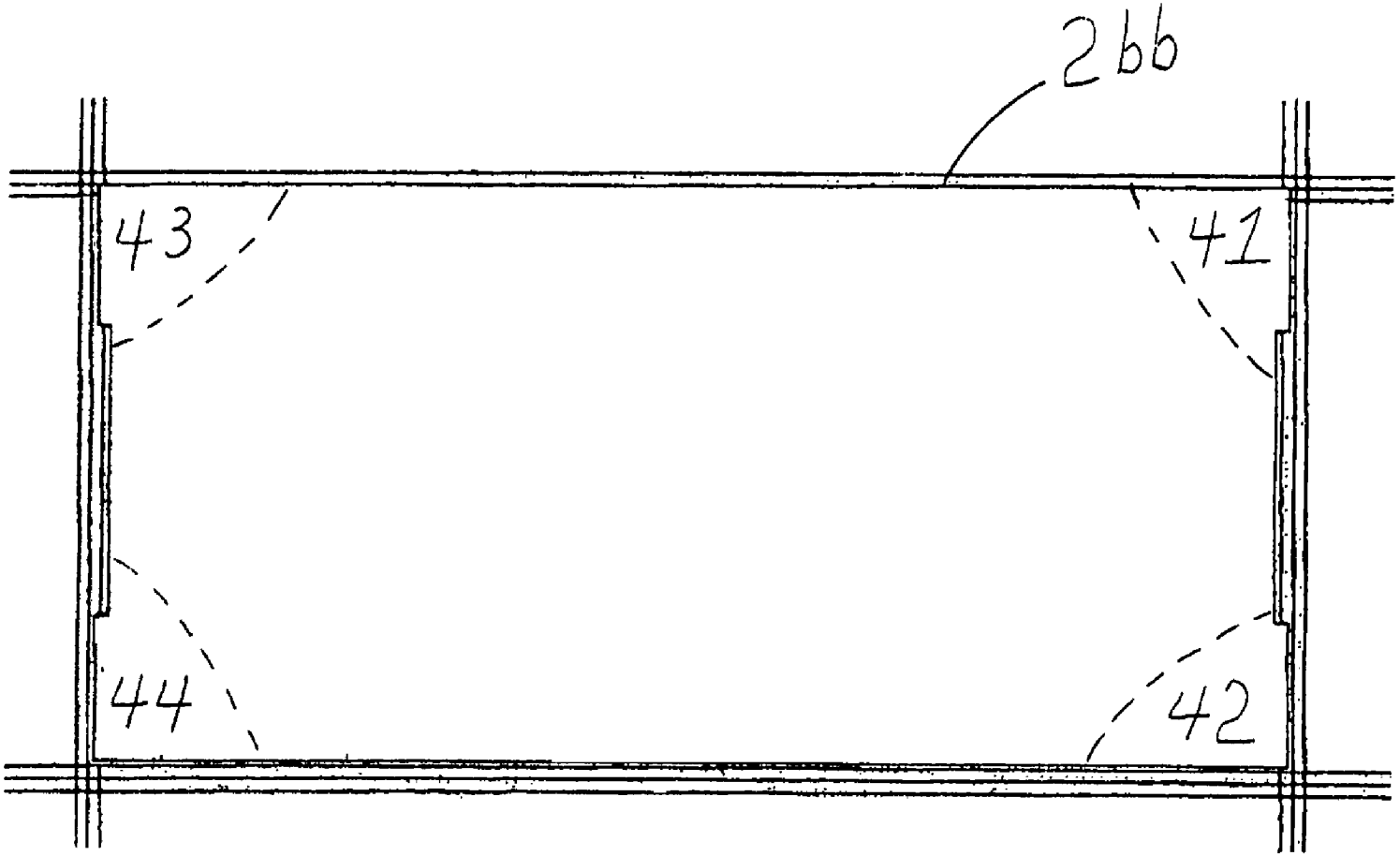
Figure No. 11

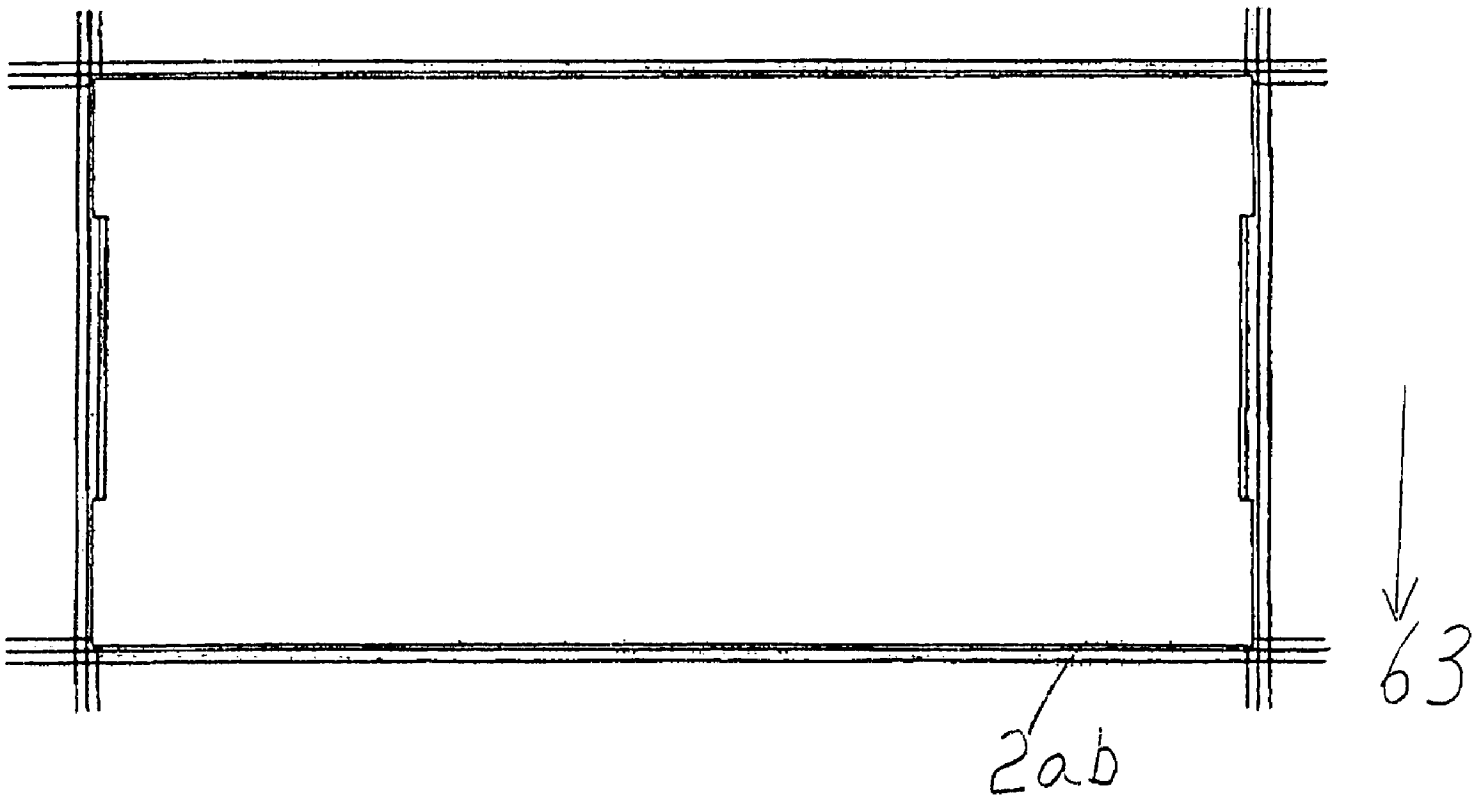
Figure No. 12

Figure No. 13
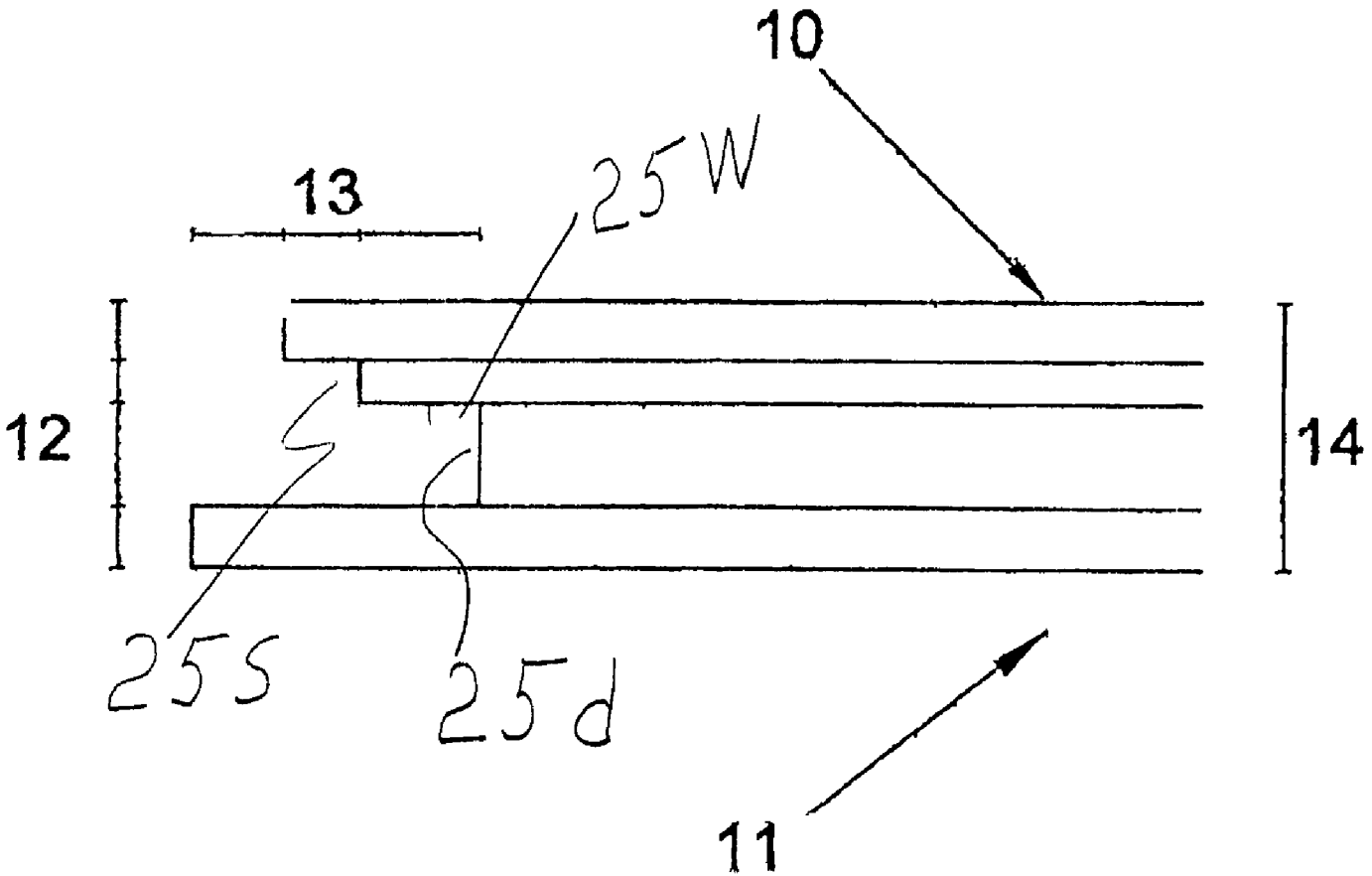

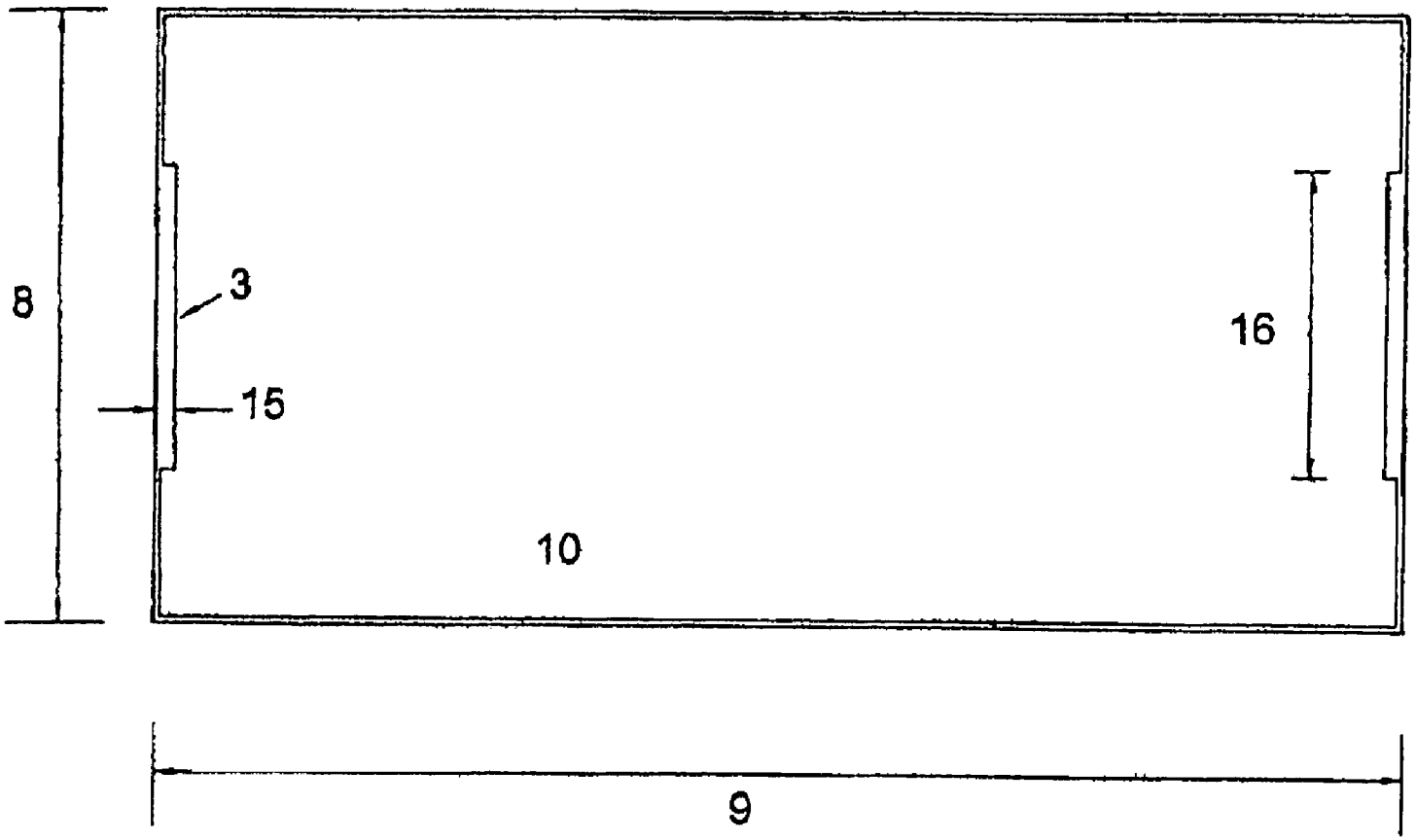
Figure No. 14

REMOVABLE CEILING PANEL

CROSS-REFERENCE TO RELATED APPLICATIONS

This application claims the benefit of the filing date of Chilean patent application Serial Number 0058-2005, filed Jan. 13, 2005 whose entire disclosure is hereby incorporated by reference.

FIELD

The invention relates to drop or false ceilings, in particular, a ceiling composed of ceiling tiles supported by a metal grid.

BACKGROUND

Grid supported ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched, especially barrel vault ceilings. However most conventional suspended ceiling systems have T-shaped grid members and those members are usually exposed to view from the room.

At least one system exists which provides a ceiling panel that is installed from beneath the support grid and partially covers the exposed grid members but leaves exposed a border of approximately 6 mm (for example the Hunter Douglas system). However that system is supported in only one direction, in other words, on two of the four sides. This renders it very unsafe. When a building is shaken by an earth tremor such ceiling panels may dislodge from the support grid and fall upon and injure people or damage property. To prevent damage and injury from falling panels, such systems are often sold with safety clips that retain the panels in the support grid in case it falls and leaves it hanging from the safety clip but out of position. The installation of such safety clips must be very precise because even a small variation in its position renders it inoperative. In addition, movement of the support grid between the moment panel first calls out of the grid and before the safety clip restrains it (e.g. another tremor) may cause the clip to fail and let the panel fall.

Panels for such systems are often made of from a clad particle agglomerate (solid) of approximately 16 mm with a weight of approximately 9.8 kg/m$^2$, implying that the panel of approximately 610×610 mm weighs approximately 3.64 kg. That is a very heavy and potentially unsafe weight when one considers that the panel is suspended above the heads of the people who live or work beneath the panels or occupy or travel through a room and that has a ceiling made of such panels. Since the prior art panels are supported on only two of their four sides, they are vulnerable to deformation because gravity is always acting on the two free sides. The weight of the panel augments the action of gravity, thereby causing the panel to deform and lose its precise retention measurements.

There is another type of ceiling panel which is a bent metal sheet hung from a support grid that has several clamps at its lower part. The bent part has a vertical shape and carries some embossing that projects from the edge for the purpose of keeping the panels secured by the clamps. That system is much more expensive than the one described above and has weight limitations, given that the design is based on the elastic strength of the steel being greater than that required for the panel to fall under gravity. In addition the system only retains the panel on two sides. When a lighting fixture is contained within the panels, the weight of the fixture deforms them.

SUMMARY

The invention relates to a removable ceiling panel. It has a rectangular shaped ceiling panel made from a suitable material with a face, a back and four sides with edges. The ceiling panel is installed from beneath the plane of the support grid and is retained horizontally in the support grid by the cooperation of the stepped perimeter of the panel with members of the flanges of the support grid.

The ceiling panel conceals the support grid. The panel is supported at its four sides and it is retained in the suspended support grid in the vertical direction by gravity. The support grid is a standard type known in the market. The design of the sides of the panel permits easy and rapid installation of the ceiling panel by following a series of defined steps. Those steps provide a procedure for installation which also forms part of the invention. The installation steps are not natural and, consequently, render the panels resistant to dislodgment during an earthquake and thus they are aseismic.

The removable modular drop ceilings are also used to cover an unsightly ceiling of a room. It provides not only an esthetically acceptable ceiling cover but also retains access to any utilities installed above the drop ceiling. However, the presence of the rectangular supporting framework with its exposed profiles detracts from the appearance of the ceiling and makes it impossible to have a ceiling which resembles a single surface with a continuous and unbroken appearance. This invention provides a new ceiling tile panel that eliminate these visual breaks, provides continuity for the ceiling, it being interlocking with the support grid, esthetic, aseismic, safe, economic and easily installable.

The field of application of the invention is the entire spectrum of ceilings which are currently installed using ceiling panels which leave exposed portions of the support grid. The invention may be used with for new ceiling installations and for replacement installations where standard support grids have been previously installed.

The invention solves one or more technical problems including concealing the profile of the support grid, making installation easy by installing the panels from below the plane of the support grid and offering improved aseismic performance by retaining the panel in place by its four sides.

The elements constituting the panel are any suitable ceiling panel material having planar characteristics (for example: approximately 1215×605×15 mm), with the suitable properties of weight, rigidity, resiliency, aesthetics and the ability to be machined so a desired shape including a special edge and grooves, that permit its installation and help conceal the profile of the support grid.

The invention provides a ceiling panel for placement in a support grid hung from a structural ceiling. Each ceiling panel is a rectangular substrate with a face on one surface and back on the other surface. The substrate has a stepped edge that may be made by a router or by building the panel in laminated layers. The stepped edge is around the perimeter of the substrate and it has a first boundary for the face, a second boundary for a deep groove, a third boundary for a shallow groove and a fourth boundary for the back. The panel has an opening between the deep groove and the back surface. In one embodiment the opening is a diagonal groove disposed between the deep groove and the back surface. In another embodiment the opening is a recess in the back extending into the deep groove. In both embodiments the opening allows flanges on the support grid members to pass through the deep groove to the back side of the panel. Then the panel is manipulated to secure it in place so that the panel is supported on four sides in its shallow groove by the flanges of the grid supports.

In addition the panels have some recesses in the perimeter of their faces allowing the bearing level to be lower by approximately nine millimeters with respect to the plane of the grid support, thereby generating a design with greater visual volume.

DESCRIPTION OF THE DRAWINGS

FIG. 1: Perspective view of a removable ceiling panel which conceals the retaining grid, having a cutout recess 3, one short side 1 and one long side 2. The upper part of the drawing corresponds to the back (22) that faces the structural ceiling.

FIG. 2: Perspective view of the location of two panels on the retaining grid 4 so as to show the resulting borders 5 which conceal the grid.

FIG. 3: Plan view of the retaining structure of a standard support grid seen from below.

FIGS. 4*a*, 4*b*, 4*c:*

FIG. 4*a* is side view of the short side of a panel with a length 8 generally of 586 mm.

FIG. 4*b* is a side view of the long side 9 of the panel, generally of 1196 mm.

FIG. 4*c* shows details of the final location of the panels in the profiled grid showing the back (upper) side (10) and the face (lower) side (11). On the opposite side is shown the deep groove edge 15 (25*d*) and the shallow groove 16 (25*s*).

FIGS. 5*a* , 5*b*, 5*c:*

FIG. 5*a* is a plan view of the back side 10 of a panel and its cutout recesses 3. FIGS. 5*b* and 5*c* are side views of the panel.

FIGS. 6*a* , 6*b:*

FIG. 6*a* shows a perspective view of the diagonal installation of a panel on flanges of the support grid 4 and an explanatory profile view FIG. 6*b* of the recess 3 that receives the retaining profile.

FIG. 7: Plan view of the panel seen from above, describing step 1 of installation.

FIG. 8: Plan view of the panel seen from above, describing step 2 of installation.

FIG. 9: Plan view of the panel seen from above, describing step 3 of installation.

FIG. 10: Plan view of the panel seen from above, describing step 4 of installation.

FIG. 11: Plan view of the panel seen from above, describing step 5 of installation.

FIG. 12: Plan view of the panel seen from above, describing step 6 of installation.

FIG. 13: Partial view of the stepped edge of a panel. The thickness of the panel is approximately 18 mm (14). Commencing from the vertex of the face (11) to the back (10) it comprises four boundaries as a function of the design of the groove being of approximately 4 mm, 7 mm, 3 mm and 4 mm (12). Taking the vertex of the face as the origin, the design of the edge has three boundaries, forming the greatest depth of the groove 25*d*, being of approximately 6 mm, 5 mm and 8 mm (13).

FIG. 14: is a plan view of the back 10 of a panel with measurement details.

FIGS. 14*b* and 14*c* show, respectively, the a short side 8 of approximately 605 mm, a long side 9 of approximately 1215 mm and a recess 3 of approximately 300 mm in length (16) by 19 mm in width (15).

DETAILED DESCRIPTION

Figure 15A:
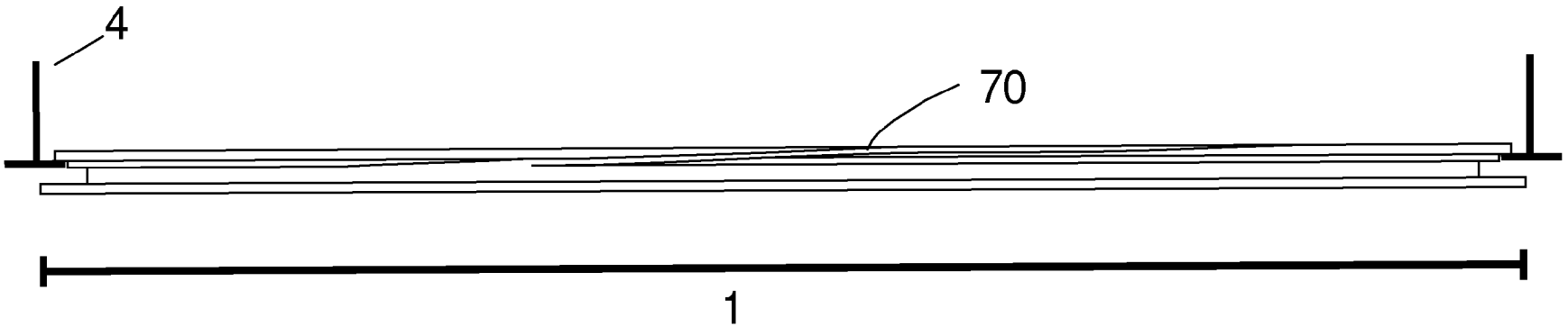
FIGS. 15*a*, 15*b*: Shows details of an alternate embodiment.

Removable, false or drop ceiling panels are a common solution for covering top surfaces of rooms. Such ceilings hide or conceal everything which is installed between said ceiling and the structural top of the room, including and not limited to concealing electrical, water, air conditioning installations, firefighting systems, etc, and the slab of the floor above the room. The installation of these panels is carried out by means of a continuous support grid in the form of an inverted T which is hung from the slab or other structural ceiling, or equivalent, by means of wires or other members designed for this purpose. See FIG. 3 A typical grid has a first set of parallel support members 91, 92, 93 with an inverted T shape that are separated from one another by a distance of approximately 610 mm, the typical width of a ceiling panel. A second set of support members 81, 82, 83 also having an inverted T shape hung transverse to the first set. The second set of cross members is separated by the typical length of a ceiling panel, e.g. approximately 1200×610 and/or 610×610 mm between axes is assembled. The whole of this design is supported on its ends by angle support members 101-104 that run round the entire perimeter. The width of the lower exposed part of the angular support member is approximately 24 mm. Into this mesh of rectangular or square openings are installed ceiling panels of mineral fiber of approximately 605×1215 mm and/or 605×605 mm with different designs. The support grids are of enameled and/or galvanized steel of approximately 0.8 mm in thickness.

The standard retaining structure comprises metal elements in the shape of an inverted T which comprise a framework of support members which provide a rectangular array of spaces of approximately 1220×610 mm or 610×610 mm between axes, with an exposed profile width of approximately 24 or 16 mm. As an example we shall take that of the larger dimensions (FIG. 3). This leaves an approximate free distance between the edges of the profile of 1196×586 mm.

Turning to FIGS. 1, 5, the invention is a rectangular ceiling tile or panel 20 with a face 21 which remains exposed and has the greatest perimeter and area, a back 22 with at least one partial cutout recess 3 on one of its sides. The face 21 has four sides or edges, 1*af*, 1*bf*, 2*af*, and 2*bf*. The back 22 also has four sides or edges l*ab*, 1*bb*, 2*ab*, and 2*bb*. Grooves 25*s* and 25*d* run around the perimeter of the panel 20 between the front and back edges. The groove 25*d* is deeper than grove 25*s* (FIGS. 4, 13). The depth range of the two grooves is approximately 3 mm to 6 mm for the shallow groove 25*s* and approximately 13 mm to 20 mm for the deep groove 25*d*. A partial cutout recess 3 in the back 22 projects into the surface of the back 22 until reaching the groove 25*d* which is the deeper of the two grooves. See FIGS. 1, 4 and 5. In other words, the panel has a face 21 that has a surface area greater than the surface area of the back 22. The larger face 21 is adjacent deep groove 25*d* and the smaller back 22 is adjacent shallow groove 25*s*.

The sides or edges of the face 21 and back 22 of the panel 20 are longer at the respective free sides which project from the retaining structure 30. See FIG. 4 and note how the distances 10 and 11 along one back and face edge are longer than the distances 8, 9 between the support members 31, 32. The panel 20 has stepped edges as shown in FIG. 13. The panel 20 may be made of multiple members laminated together to provide the stepped edges. As an alternative, the panel may be made of a single substrate that is routed on its edges to provide the stepped profile where the lateral boundary of the face is longest, the lateral boundary of the back in next in length, followed in decreasing order by the shallow groove 25*s* and the deep groove 25*d*. Note that the boundary of the face edge 11 is longest. Above it is the boundary of the deeper groove 25*d*. Next is the boundary of the shallow groove 25*s* and finally the boundary of the back edge 10. The back edge 10 is shorter than the face edge 11 and forms a wall of the shallow groove 25*s*. The deep groove 25*d* is disposed between the face 21 and the wall 25*w* of the shallow groove 25*s*.

The width of the face 21 is chosen to be approximately half the distance between spaced apart grid support members. In this way, faces of adjacent panels will register or abut each other to provide a continuous surface unbroken by support grids. See, for example, FIG. 4*c* where length 11 of the face is long enough to overlap about half the width of the support members 31, 32. Note also how the deep groove 25*d* is shorter than the width between flanges 31, 32, how the length of the shallow groove 25*s* is about the same as the distance between flanges and the how the length 10 of the back is long enough to overlap a portion (but less than half) of the width of the flanges 31, 32. Once the panel 20 is installed, the stepped edge of the panel securely holds the panel 20 in the grid space and on the flanges. This renders it almost impossible for random motion such as caused by an earthquake to cause the panel to enter or leave this structure once it has been installed.

In order for the panel 20 to enter or exit a space in the assembled support grid structure, the panel has a partial cutout recess 3 on at least one side. In a preferred embodiment the recess 3 is disposed on the two short sides 1*ab*, 1*bb*. The recess 3 is large enough to permit a flange 4 of one of the support members of the structure to enter the stepped edge diagonally at the bottom of the deep groove 25*d* and leave one corner of the back on the flange of the grid and the other under the grid. See FIGS. 6*a*, 6*b*. As will become clear for the following explanation, the recess 3 provides an opening for sliding a flange of a support member from the deep groove 25*d* to above the back 22 of the panel. Once the panel 20 is in place, a motion caused by an earthquake would be insufficient to remove the panel.

Given the design of the ceiling panel 20, its installation is carried out in accordance with the procedure subject of this patent and which comprises the following steps:

Step 1. Raise the panel 20 with its face 21 down and level with the grid. See FIG. 7. The back 22 of the panel has two short sides 1*ab*, 1*bb*, and two long sides 2*ab*, 2*bb*. The sides meet in corners 41, 42, 43, 44. The support members included flanges 51, 52, 53, 54 that project into the rectangular space defined by the support grid members.

Step 2. Fit the panel diagonally to short side 1*bb*, with the recess 3, so that the flanges 51 is introduced into the portion of deep groove 25*d* from the corner 44 to the recess, leaving the lower end of the flange 51 over the portion from the recess to the corner 43. The panel stay in an angle and slide over the upper end of flanges 51, 52 to leave corners 42, 43 under the lower end of flanges 51, 52. See FIGS. 6*b*, 8.

Step 3. Displace the panel 20 in the direction shown by arrow 60 in FIG. 8. This direction is parallel to the support flanges 51, 52 and in the direction of the higher corners 41, 44. Move panel 20 until the flange 53 of the support member is fully introduced into the deeper groove 25*d* of the long side 2*bb*, such that the panel 20 has one side 2*bb* and its corners 41, 44 fitted into the deep groove thus leaving the opposite side 2*ab* free with respect to the back and the flange 54. See FIG. 9.

Step 4. Raise the free corner 42 opposite the fitted corner 44 until the panel 20 is level on those sides with respect to the flanges of the profile. This step is fundamental in order that the result be aseismic and is an operation which it would be difficult for nature to carry out. This is because the step deforms both the panel 20 and the support grind structure. The deformation is caused by the lever effect which is applied to the free corner 42, with respect to the fitted side 2*bb* and the diagonal fitted section of the side 1*bb*. The panel 20 or the support members or both are resilient and return to their normal shape after the small deformation needed to set the panel in place in the grid. Once leveled, the panel is slid parallel to the fitted long side until the free short sides 1*ab* are fully introduced into the deep groove 25*d*. In this manner the short sides which are fitted diagonally are freed and the lever is completed. See FIG. 10.

Step 5. Raise the free corners 43 opposite the fitted corners 41 until the panel 20 is level on those sides with respect to the flanges of the profile. Displace the panel in the direction of arrow 62 and parallel to the long side toward the free short side 1*ab* until it is supported by the shallow groove 25*s*. As a result the projecting side is also supported by its shallow groove. At this point the panel is supported by two shallow groves 25*s* on its short sides 1*ab*, 1*bb* and by a deep groove 25*d* on one long side 2*bb*. See FIG. 11.

Step 6. Displace the panel in the direction of arrow 63 toward the free long side 2*ab* until it is supported by its shallow groove. As a result four sides of the panel are fitted into shallow grooves 25*s*, taking up its definitive position fitted at its four sides. See FIGS. 2 and 12.

A practical example of this invention is a panel of approximately 18 mm in thickness comprising an MDF frame (special lightweight medium density fiberboard) having within it approximately 12 mm of expanded polyethylene, and two MDF faces of approximately 3 mm which enclose the material of approximately 12 mm. Each MDF face of approximately 3 mm is clad on its external face with wood veneer and is varnished. The panel has a length of approximately 1215 mm by 605 in width on its face and a thickness of approximately 18 mm. The perimetric groove at its deepest part is approximately 7 mm wide and 19 mm deep, at a distance from the vertex of the face of approximately 4 mm. The lesser groove is approximately 11 mm deep with respect to the same vertex of the face and is at a distance of approximately 4 mm from the vertex of the back. Finally the back is recessed approximately 6 mm with respect to the vertex of the face. See FIGS. 13, 14.

Figure 15B:
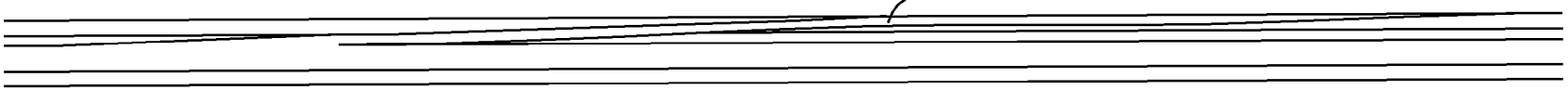

The function fulfilled by the cutout recess is to permit the flange of the retaining profile to enter diagonally, this latter being introduced into the deepest level of the groove. The same effect may be achieved by means of a diagonal groove 70 that leaves free the area where the flange of the retaining member must enter the edge of the panel to be able to carry out the installation. See FIGS. 15*a* and 15*b*.

The invention claimed is:

1. A ceiling panel for placement in a support grid hung from a structural ceiling, said ceiling panel comprising:

a rectangular substrate with a face on one surface and a back on the other surface;

a stepped edge on at least a portion of each of each edge of the substrate, said stepped edge having a first boundary for the face, a second boundary for a deep groove, a third boundary for a shallow groove and a fourth boundary for the back, wherein the deep groove is adjacent the face and extends around each edge of the substrate and the shallow groove is between the deep groove and the back and extends at least in part around the each edge of the substrate; and an opening between the deep groove and the back surface.

2. The ceiling panel of claim 1 wherein the opening comprises a diagonal groove disposed between the deep groove and the back surface.

3. The ceiling panel of claim 1 wherein the opening comprises a recess in the back extending into the deep groove.

4. A method for installing the ceiling panel as claimed in claim 1 which comprises the following steps: raising the panel to a retaining structure and leveling it with its exposed face downwards and its back face upwards; fitting portions of deep grooves of edges of the panel onto a flange by threading the flange though an opening between one of the deep grooves and the back surface to place portions of the (two) opposite flanges in opposite deep grooves; displacing the panel parallel to the threaded flange to fit one long edge of the panel onto a third flange that is transverse to the other two flanges until leading corners of the panel are fitted into opposite corners; lifting the opposite, free corners until the panel is level at those sides with respect to the flange of the support grid; sliding the panel parallel to the fitted long edge until the free short side is fully within the deep groove, leveraging the remaining corner to be level with the back; displacing the panel parallel to the long side toward the free short side until it is the free short side is supported by the shallow groove so that the panel is supported by two shallow grooves on its short sides and by a deep groove on one long side; and displacing the panel toward the free long side until it is supported by its shallow groove, as a result of which its four sides are fitted into the shallow grooves taking up its definitive position, fitted in its four sides.

5. A removable ceiling panel wherein the panel is of rectangular shape, its four edges being grooved and recessed and containing three elements;

the first being the face which has the greatest dimensions and which is the exposed part once the panel has been installed, in comparison with the back which is not exposed and which is of the same or of lesser dimensions within an approximate range from 0 to a maximum of 7 mm in each side;

a second element which comprises a perimetric groove in the four sides of the panel, said perimetric groove having two depth levels, the first level adjacent to the face and has a depth of an approximate range from a minimum of 13 mm to a maximum of 20 mm and a second level which is less than the first level and within an approximate range from a minimum of 5 mm to a maximum of 12 mm; and a third element comprising an opening extending between the back of the first element and the deeper level groove of the second element such opening having a length of approximately 1 cm minimum and 58 cm maximum.

6. The registerable ceiling panel wherein the opening of claim 5 may alternatively be on only one of its sides or on the four sides and, in this manner, should the length of the panel differ from its width, the opening in the long side will be of a minimum of approximately 1 cm and a maximum of approximately 120 cm.

7. The registerable ceiling panel as claimed in claims 1 or 5 wherein the height of the grooves may vary in accordance with the material which is used for installation in the ceiling, for rigid materials being approximately 7 mm and for flexible materials approximately 2 mm.

8. The registerable ceiling panel as claimed in claims 1 or 5 wherein the opening permits a flange of the supporting grid to enter diagonally the deep groove.

9. The registerable ceiling panel of claim 1 or 5 wherein a diagonal groove provides an opening between the deep groove and the back.

10. The registrerable ceiling panel of claim 1 wherein the shallow groove is continuous around the periphery of the tile.

11. The registerable ceiling panel of claims 1, 2, or 3 wherein the deep groove is present on all edges of the tile and is discontinuous in regions defining the opening to the back surface.

12. The registrerable ceiling panel of claim 1 or 4 wherein each groove or each level of a groove is defined by a pair of walls spaced apart by an opening at one end of the walls and a floor at the other end of the walls.

* * * * *